US006435974B1

(12) United States Patent
Chen

(10) Patent No.: US 6,435,974 B1
(45) Date of Patent: Aug. 20, 2002

(54) AIMING DEVICE OF GOLF PUTTER

(76) Inventor: David Chen, 9F-1, No. 629, Sec. 1, Chung Teh Road, Taichung (TW)

( * ) Notice: Subject to any disclaimer, the term of this patent is extended or adjusted under 35 U.S.C. 154(b) by 0 days.

(21) Appl. No.: 09/624,181

(22) Filed: Jul. 24, 2000

(51) Int. Cl.[7] ..... A63B 57/00; A63B 69/36
(52) U.S. Cl. ..... 473/220; 473/201; 473/206
(58) Field of Search ..... 473/219, 220, 473/221, 257; 33/260, 253, 254, 255, 256, 257, 258, 259

(56) References Cited

U.S. PATENT DOCUMENTS 3,070,373 A * 12/1962 Mathews et al. ..... 473/220
3,975,688 A * 8/1976 Kroger et al. ..... 358/190
4,406,040 A * 9/1983 Cannone ..... 24/3.12
D362,862 S * 10/1995 Barton ..... D16/237
5,494,290 A 2/1996 Stefanoski
5,611,739 A 3/1997 Carney
5,692,965 A * 12/1997 Nighan, Jr. et al. ..... 473/220
5,788,588 A * 8/1998 Hooker ..... 473/409
5,919,098 A * 7/1999 Salmon ..... 473/220

* cited by examiner

*Primary Examiner*—Paul T. Sewell
*Assistant Examiner*—Alvin A. Hunter
(74) *Attorney, Agent, or Firm*—Browdy and Neimark, P.L.L.C.

(57) ABSTRACT

A golf putter is provided with an aiming device comprising a fastening member which is detachably fastened with the golf putter and is provided with a housing pivoted therewith. The housing contains a laser beam device for emitting a laser beam to serve as a reference indication line along which a golf ball is to travel. A main body is provided at the fastening member. A power source and a switch are mounted on the main body.

9 Claims, 5 Drawing Sheets

AIMING DEVICE OF GOLF PUTTER

FIELD OF THE INVENTION

The present invention relates generally to a golf putter, and more particularly to an aiming, device of the golf putter.

BACKGROUND OF THE INVENTION

The U.S. Pat. No. 5,494,290 discloses an aiming device which is made with a golf putter, in a built-in fashion. As a result, a golfer must purchase a putter without the aiming device for use in a tournament. Another U.S. Pat. No. 5,611,739 discloses an aiming device which is detachably fastened with a golf putter. The aiming device is defective in design in that it must be calibrated after it is detached from the golf putter and is then put back on the putter.

SUMMARY OF THE INVENTION

The primary objective of the present invention is to provide a golf putter with an aiming device which is detachably fastened with the golf putter to facilitate the golf practicing by a golfer.

It is another objective of the present invention to provide a golf putter with an aiming device which is detachably fastened with the golf putter and can be reattached to the golf putter without having to calibrate the device after the first time use.

The aiming device of the present invention comprises a fastening member which is detachably fastened with a golf putter. A housing pivoted with the fastening member, whereby the housing can be turned to any specific angle and fastened with the fastening member to remain in the angle. The housing contains a laser beam device for emitting an indication projection. A main body is provided on the fastening member. A power source and an switch are mounted at the main body.

DETAILED DESCRIPTION OF THE INVENTION

Figure 1:
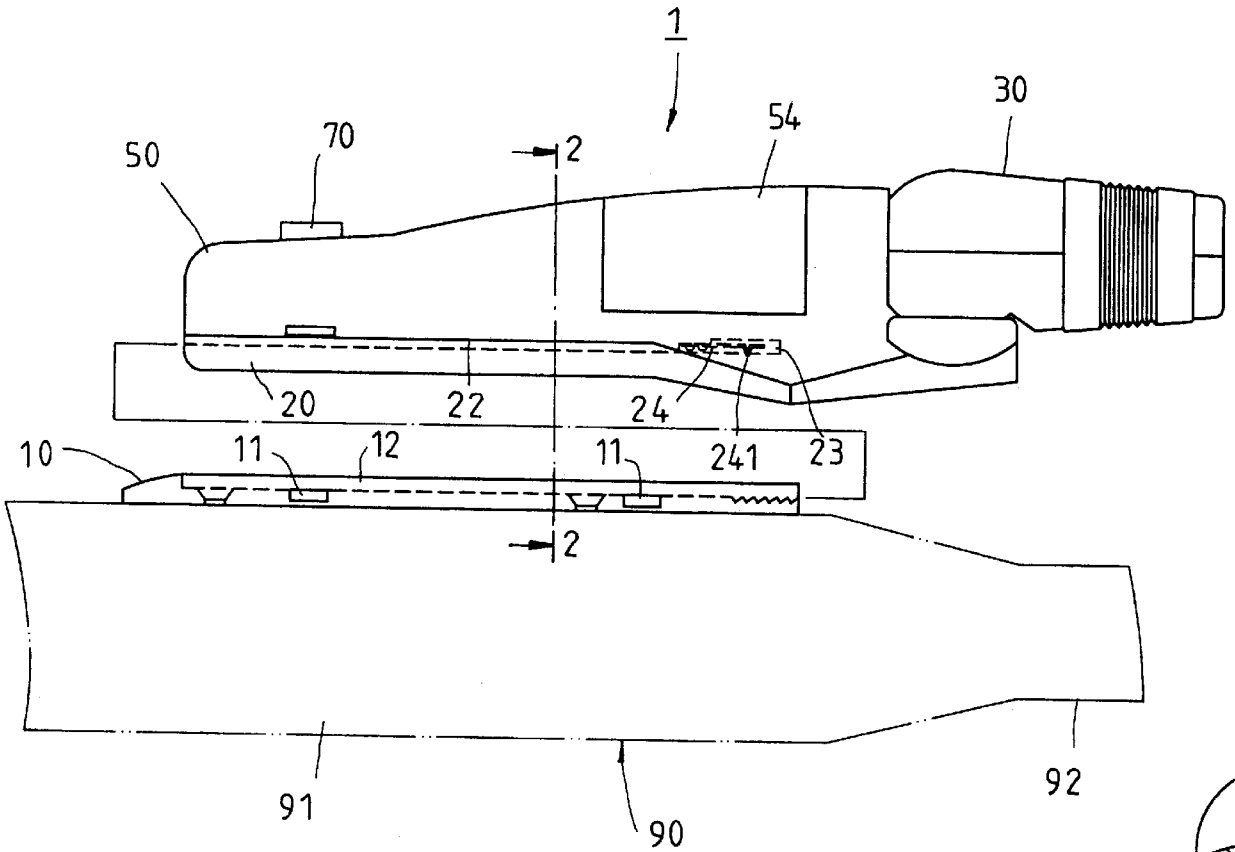
FIG. 1 shows an exploded view of a first preferred embodiment of the present invention.
Figure 2:
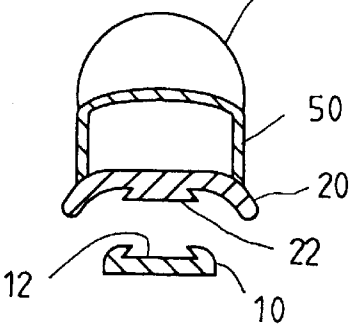
FIG. 2 shows a sectional view of a portion taken along the direction indicated by a line 2—2 as shown in FIG. 1.
Figure 3:
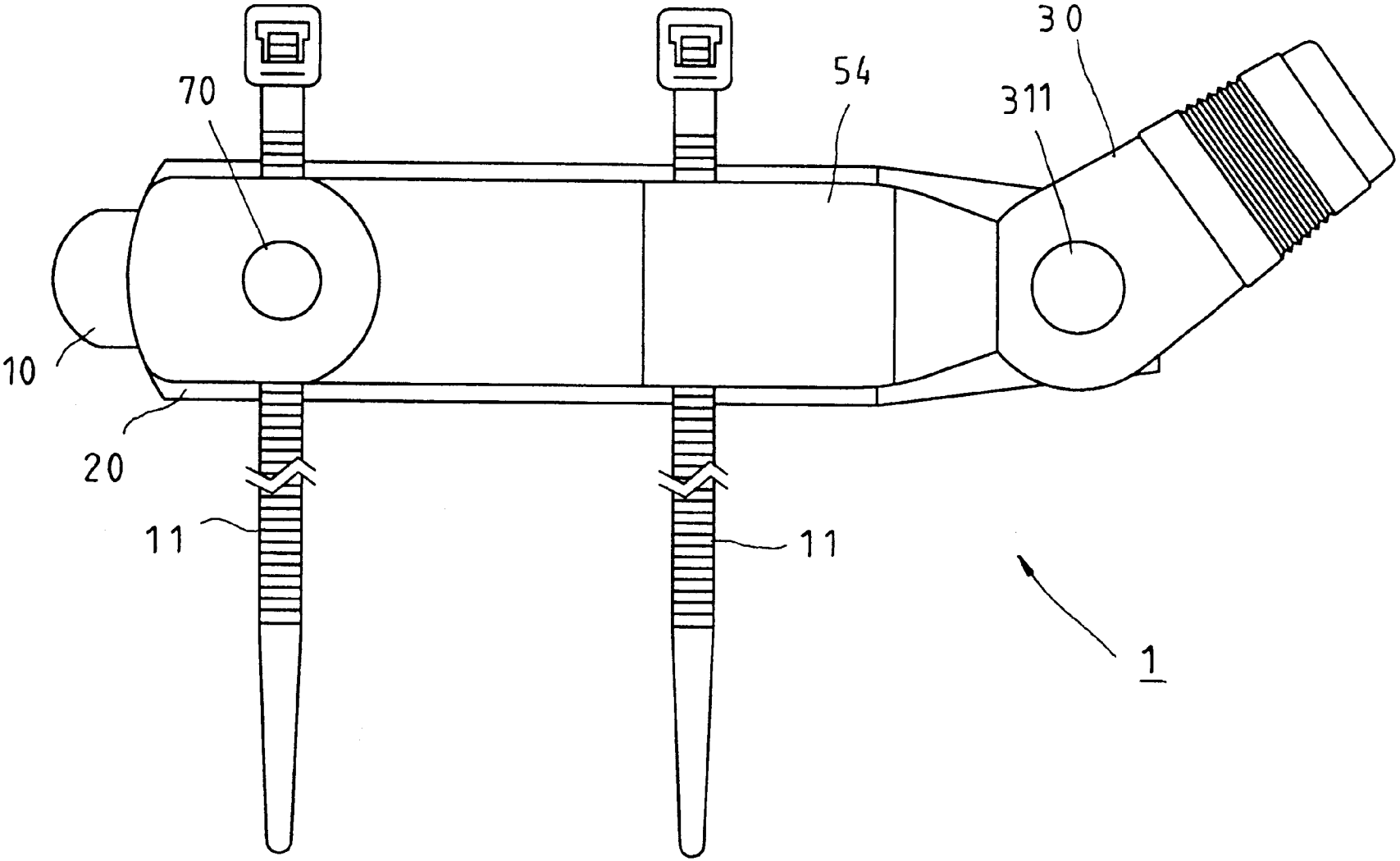
FIG. 3 is a top view of the first preferred embodiment of the present invention.
Figure 4:
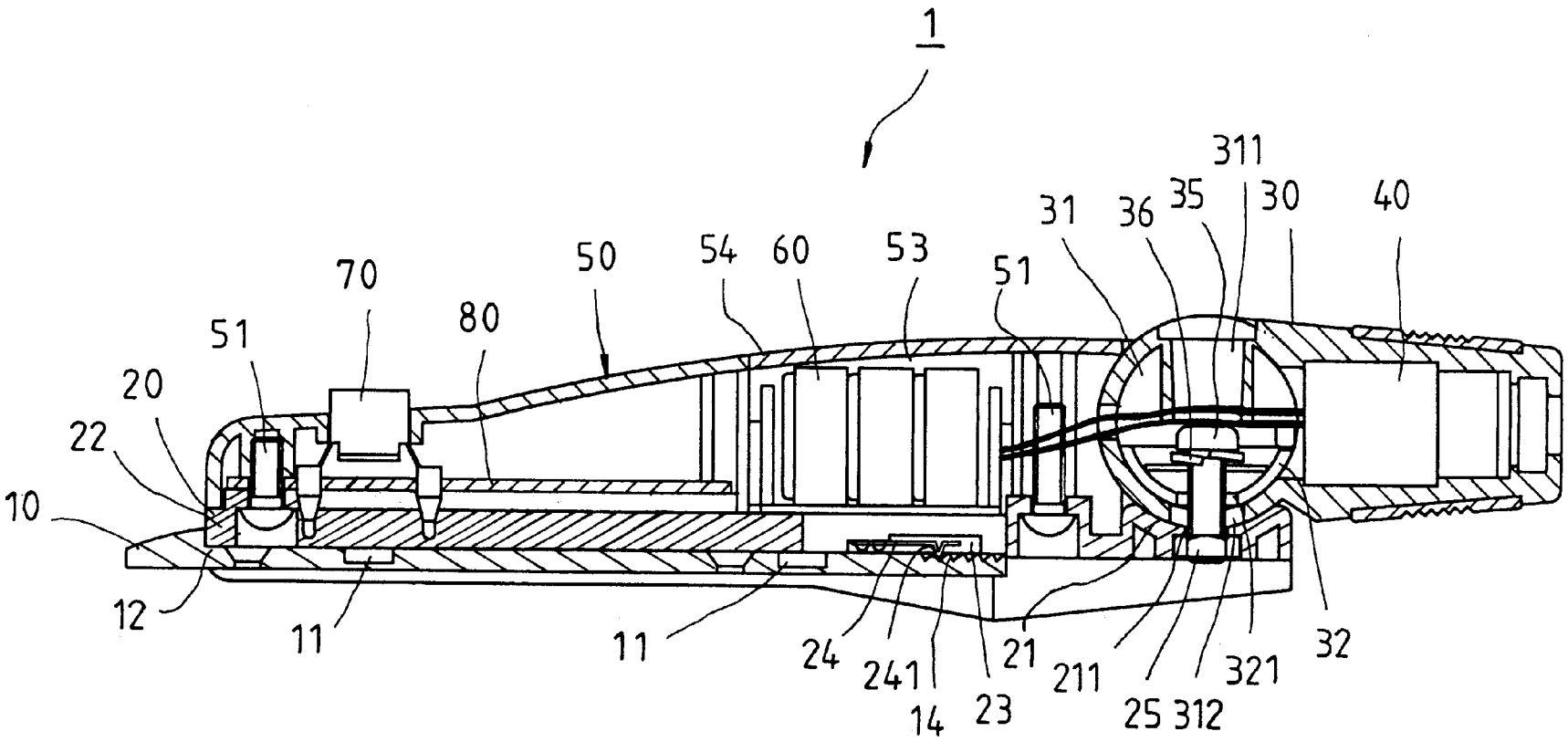
FIG. 4 shows a front sectional view of the first preferred embodiment of the present invention.

As shown in FIGS. 1–5, an aiming device 1 embodied in the present invention is intended for use with a golf putter and is formed of the component parts which are described hereinafter.

a fastening mount 10 is of a long platelike construction and is detachably fastened with a grip 91 of a golf putter 90 as indicated by the dotted lines in FIGS. 1 and 3 by bond or screws. The fastening mount 10, is provided with two retaining straps 11 for further securing the fastening mount 10 to the putter 90. The fastening mount 10 is further provided with a retaining slot 12 of a predetermined length and extending along the longitudinal direction thereof. The retaining slot 12 is trapezoidal in its cross section.

A fastening member 20 is of a long platelike construction and is provided with a pivoting portion 21. The fastening member 20 is provided in the underside. with a retaining projection 22 of a predetermined length and extending along the longitudinal direction thereof. The fastening member 20 is joined with the fastening mount 10 such that the retaining projection 22 is received in the retaining slot 12. The fastening member 20 is provided in the bottom with a receiving compartment 23 having a flexible retaining piece 24. The retaining piece 24 is fastened at one end thereof with the fastening member 20 and is provided in the underside thereof with a protruded portion 241, which is received in one of locating slots 14 which provided at the fastening mount 10.

A housing 30 has an interior which is provided with a pivoting cell 31 of a spherical construction. The pivoting cell 31 is provided with an upper hole 311, a lower hole 312, and a locating member 32 which is of a spherical construction and is disposed in the pivoting cell 31. The locating member 32 is provided with a through hole 321. The pivoting portion 21 is provided with an axial hole 211. A fastening screw 35 with a washer 36 is received in the pivoting cell 31 via the upper hole 311 such that the screw is put through the through hole 321, the lower hole 312 and the axial hole 211 to engage the nut 25. The housing 30 is pivoted with the pivoting portion 21 and is capable of turning on the screw 35 serving as an axis. As the screw 35 is tightened, the locating member 32 presses against the housing 30, which is thus fastened with the pivoting portion 21.

A laser beam device 40 is disposed in the housing 30 for projecting an indication line.

A main body 50 is of a shell-like construction and is fastened with the fastening member 20 by two screws 51. The main body 50 is provided with a battery mount 53, an opening 54 located over the battery mount 53, and a cap 55 fastened with the main body 50 for sealing off the opening 54.

A power source 60 is to provide the laser beam device 40 with power and is formed of three mercury batteries which are mounted serially in the battery mount 52 of the main body 50. The opening 54 is intended to facilitate the disposing and the replacing of the batteries.

A switch 70 is disposed on the main body 50 for turning on or off the laser beam device 40 and is provided with a delay circuit 80 for cutting the power of the laser beam device 40 after a predetermined period when pushed the switch 70.

Figure 5:
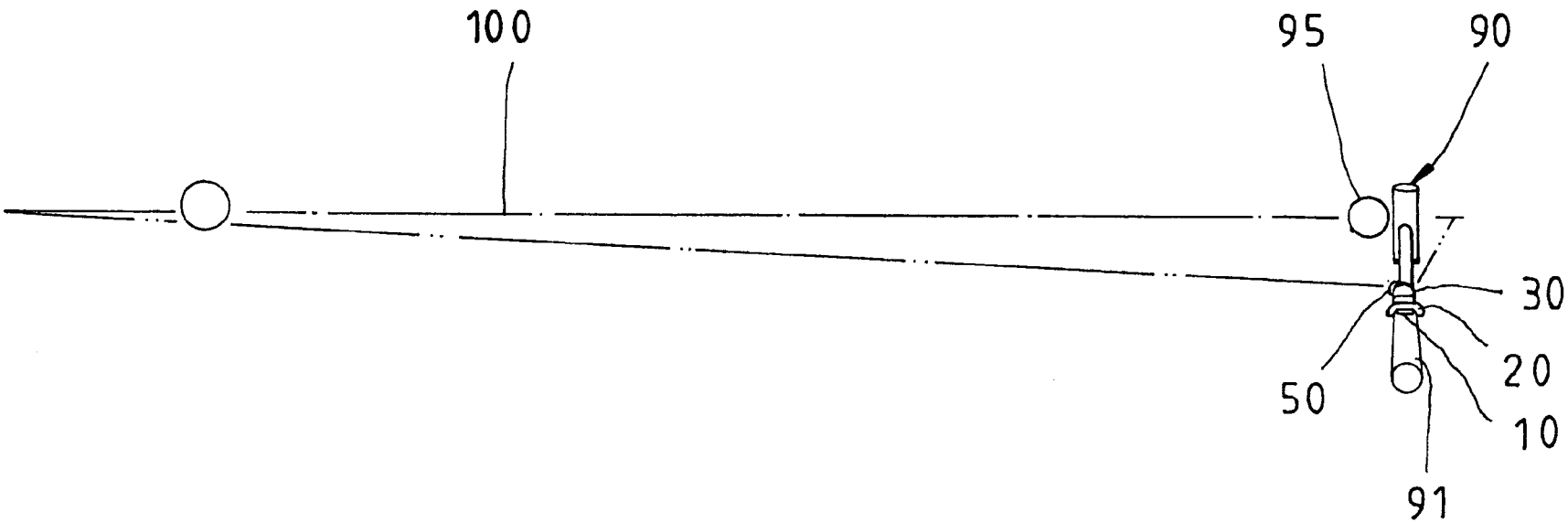
FIG. 5 shows a schematic view of the first preferred embodiment of the present invention in action.

In operation, the device 1 is detachably fastened with the grip 91 of the putter 90 such that the fastening mount 10 is secured to the grip 91 by the two retaining straps 11. The pivoting angle of the housing 30 is so adjusted as to enable the laser beam device 40 to project an indication line 100 in the direction in which a golf ball 95 is to travel, as illustrated in FIG. 5. The indication line 100 serves as an aiming reference. In other words, the device 1 is use by a golfer as a practicing aid. It must be noted here that the device 1 of the present invention doesn't need to calibrate each time when the fastening member 20 is joined with the fastening mount 10 after first time use.

Figure 6:
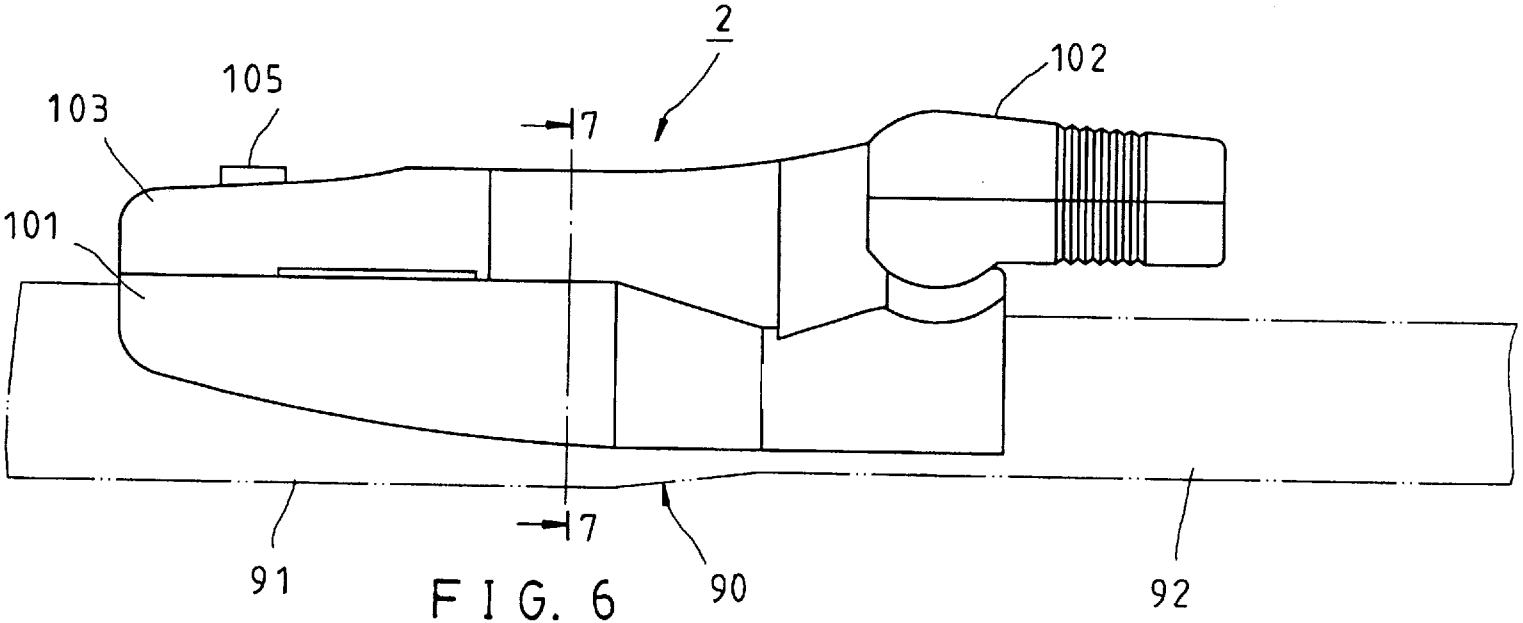
FIG. 6 shows a front view of a second preferred embodiment of the present invention.
Figure 7:
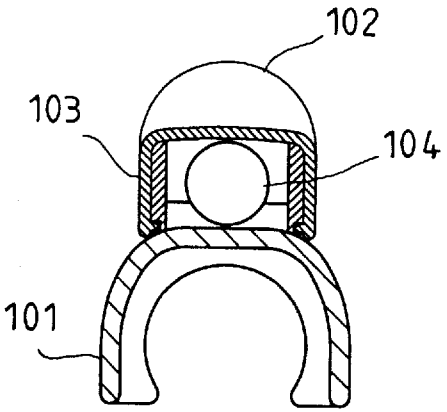
FIG. 7 shows a sectional view of a portion taken along the direction indicated by a line 7—7 as shown in FIG. 6.

As shown in FIGS. 6 and 7, an aiming device 2 of the second preferred embodiment of the present invention is basically similar in construction to the device 1 of the first preferred embodiment described above and is formed of a fastening member 101, a housing 102, a laser beam device (not shown in the drawings), a main body 103, a power source 104, and a switch 105. The device 2 is different from the device 1 in design in that the former is devoid of the fastening mount 10, and that the fastening member 101 has a C-shaped cross section corresponding to the grip 91 and the shaft 92 of the putter 90, thereby enabling the fastening member 101 to be detachably fastened with the putter 90.

What is claimed is:

1. An aiming device of a golf putter, said device comprising:

a fastening mount adapted to be fixed to a grip on shaft of the golf putter;

a fastening member slidably engaged along a longitudinal axis thereof to the fastening member, having a concave mounting at an end thereof;

a main body fixed on the fastening member;

a housing rotatably engaged in the concave mounting at a convex end of the housing corresponding in shape to the concave mounting, the convex end of the housing abutting an end of the main body;

a laser beam device disposed in said housing to emit a laser beam as a reference indication line along which a golf ball is to travel;

wherein the laser beam housing rotates in the concave mounting around an axis perpendicular to an axis of the fastening member and in a plane of the main body to adjust a projection of the reference indication line along a path the golf ball is to travel; and means on the housing to fix the housing in the concave mounting at a selected projection of the reference indication line.

2. The device as defined in claim 1, further comprising:

a power source disposed in said main body to provide said laser beam device with power; and a switch disposed on said main body to turn said laser beam device on or off.

3. The aiming device as defined in claim 1, wherein said fastening member is provided with a flexible retaining piece; wherein said fastening mount is provided with at least one locating slot whereby said retaining piece is received in said locating slot at the time when said fastening member is joined with said fastening mount.

4. The aiming device as defined in claim 1 further comprising at least one retaining strap on the fastening mount for securing said fastening mount to the grip or shaft of the golf putter.

5. The aiming device as defined in claim 1, wherein said housing is provided with a locating member for rotatably engaging the housing with the concave mounting by a screw, wherein said screw is extended through said locating member such that said locating member forces said housing to be fixed to the concave mounting when said screw is tightened.

6. The aiming device as defined in claim 5, wherein said housing is provided with a pivoting cell including the convex end of the housing, the pivoting cell having an upper hole and a lower hole; wherein said locating member is provided with a through hole and is disposed in the convex end by a screw which is engaged with a nut via said through hole, said upper hole, said lower hole, and an axial hole of the concave mounting.

7. The aiming device as defined in claim 2, wherein said main body is provided with an opening corresponding in location to said power source, said main body further provided with a cap for covering releasably said opening.

8. The aiming device as defined in claim 7, wherein said main body is provided with a battery mount corresponding in location to said opening; wherein said power source comprises a plurality of mercury batteries which are disposed in said battery mount.

9. The aiming device as defined in claim 1, wherein further comprising a delay circuit which is provided in said main body for cutting the power of said laser beam device after a predetermined period after pushing said switch.

* * * * *